US006286413B1

(12) United States Patent
Hochhalter

(10) Patent No.: US 6,286,413 B1
(45) Date of Patent: Sep. 11, 2001

(54) DIAPHRAGM ACTUATOR

(75) Inventor: Keith Hochhalter, Minnetrista, MN (US)

(73) Assignee: Tol-O-Matic, Inc., Hamel, MN (US)

( * ) Notice: Subject to any disclaimer, the term of this patent is extended or adjusted under 35 U.S.C. 154(b) by 0 days.

(21) Appl. No.: 09/361,102

(22) Filed: Jul. 26, 1999

Related U.S. Application Data

(63) Continuation-in-part of application No. 09/027,427, filed on Feb. 20, 1998, now Pat. No. 5,927,177.

(51) Int. Cl.[7] ..... F01B 19/00
(52) U.S. Cl. ..... 92/101; 92/97; 92/98 R
(58) Field of Search ..... 92/48, 50, 96, 92/98 R, 101, 102, 97

(56) References Cited

U.S. PATENT DOCUMENTS

| | | | | |
|---|---|---|---|---|
| 1,371,242 | | 3/1921 | Hopwood | 92/101 |
| 2,292,896 | * | 8/1942 | Morgan | 92/101 X |
| 2,372,813 | | 4/1945 | Darling | 92/98 |
| 2,545,857 | | 3/1951 | Perkins et al. . | |
| 2,658,525 | | 11/1953 | Shannon . | |
| 2,820,434 | | 1/1958 | Otto . | |
| 2,871,795 | * | 2/1959 | Smith | 92/98 R X |
| 3,251,305 | | 5/1966 | Schlosser . | |
| 3,497,038 | | 2/1970 | Schrader et al. . | |
| 3,502,004 | | 3/1970 | Schrader . | |
| 3,563,138 | | 2/1971 | Symonds et al. . | |
| 3,626,813 | | 12/1971 | Kreuter . | |
| 3,722,373 | | 3/1973 | Beach et al. . | |
| 3,817,264 | | 6/1974 | Kilayko | 92/101 |
| 3,899,959 | * | 8/1975 | Bertrand et al. | 92/100 |
| 3,975,989 | | 8/1976 | Hirmann | 92/48 |
| 4,038,506 | * | 7/1977 | Filip | 92/98 R X |
| 4,208,031 | * | 6/1980 | Jonak | 92/97 X |
| 4,209,000 | * | 6/1980 | Ivie | 92/97 X |
| 4,272,999 | | 6/1981 | Perry . | |
| 4,522,220 | | 6/1985 | Multrus . | |
| 4,565,501 | | 1/1986 | Laurendreau et al. . | |
| 4,615,353 | | 10/1986 | McKee . | |
| 4,754,776 | | 7/1988 | McKee . | |
| 5,796,007 | * | 8/1998 | Panagotopulos et al. | 73/716 |

FOREIGN PATENT DOCUMENTS

| | | | |
|---|---|---|---|
| 513977 | 10/1939 | (GB) | 92/48 |
| 631186 | 10/1949 | (GB) | 92/48 |
| 1323108 | 7/1973 | (GB) . | |
| 901674 | 5/1982 | (SU) . | |

* cited by examiner

*Primary Examiner*—John E. Ryznic
(74) *Attorney, Agent, or Firm*—Dorsey & Whitney LLP

(57) ABSTRACT

A multiple diaphragm actuator for exerting linear forces of precise and repeatable amounts in opposite directions with no friction and no fluid leakage.

19 Claims, 10 Drawing Sheets

DIAPHRAGM ACTUATOR

This application is a continuation-in-part of Ser. No. 09/027,427 filed Feb. 20, 1998 now U.S. Pat. No. 5,927,177.

BACKGROUND OF THE INVENTION

1. Field of the Invention

The present invention relates generally to a diaphragm actuator, and more specifically to a diaphragm actuator for the high speed exertion of forces of precise and repeatable amounts with no friction and with no fluid leakage. The invention also relates to a multiple diaphragm actuator for applying linear forces in opposite directions at a point positioned entirely to one side of the actuator.

2. Description of the Prior Art

A variety of what are commonly referred to as diaphragm actuators exist in the art for applying a force to a work piece. A common actuator of this type includes a pair of pressure chambers separated by a diaphragm with means for selectively introducing fluid pressure into, and exhausting fluid pressure from, the pressure chambers. Commonly associated with the diaphragm is an elongated actuator rod which is movable with the diaphragm. This rod extends through one of the pressure chambers and through a sealed opening in the pressure chamber to a work piece. With this type of actuator, forces exerted on the diaphragm and thus the actuator rod by the pressure chambers are controlled by selective introduction and exhaustion of fluid pressure into and out of the opposed pressure chambers.

However, several potential problems exist with this design: First, friction and potential for leakage exist between the actuator rod and the seal members which seal the rod as it exits the one chamber. Whenever there is a possibility of friction and/or leakage, extreme accuracy and repeatability are virtually impossible. Second, the seal members sealing the rod as it exits the one chamber will eventually wear-out and thus need replacement. This results in further inaccuracy and non-repeatability. Thirdly, the volumes of the two opposing chambers are not exactly matched because of the existence of the rod in the one chamber and because the amount of the rod within the one chamber varies as the chamber expands and contracts. This again adversely affects the accuracy of the forces generated on the rod and the repeatability of force generation. Fourthly, because the volume of the chambers must be filled before any force is exerted, rapid-high speed exertion of forces is limited. Accordingly, with known diaphragm actuators such as those described above, the application of extremely accurate, high speed and repeatable forces is difficult, if not impossible, to achieve.

Accordingly, there is a need in the art for an improved diaphragm actuator which is capable of providing extremely accurate, high speed and repeatable forces and which virtually eliminates any inaccuracies and any repeatability concerns resulting from friction or leakage of fluid from the pressure chambers.

SUMMARY OF THE INVENTION

In contrast to the prior art, the present invention relates to a diaphragm actuator which is capable of providing an extremely accurate, high speed and repeatable linear force. This is possible by providing a system having one or more pressure chambers with no seals to wear-out or to create friction or leakage. Further, the diaphragm actuator of the present invention eliminates the existence of any actuator rod within a pressure chamber and substantially reduces or eliminates the chamber volume. Accordingly, with the diaphragm actuator of the present invention, a relatively large, two-directional linear force can be generated at a force receiving point at high speed without loss of accuracy, efficiency or repeatability due to fluid leakage or friction. Further, with the actuator of the present invention, such a two-directional linear force can be generated at a point which is positioned entirely to one side of the diaphragm actuator.

More specifically, one embodiment of the diaphragm actuator in accordance with the present invention includes first and second opposed fluid pressure chambers or cells each having a fluid inlet/outlet port and a diaphragm responsive to the fluid pressure in the respective pressure chamber. Preferably, the fluid pressure chambers and the diaphragms are oriented such that their diaphragms are parallel to oppose one another so that the linear forces exerted by the diaphragms are collinear and are in opposite directions.

In this embodiment, the diaphragm actuator of the present invention further includes an actuator arm assembly which preferably includes a pair of piston members engaging the outer surfaces of the respective diaphragms to receive the respective linear forces from the diaphragms. The actuator arm assembly further preferably includes an arm portion connected with the pistons to transfer the linear forces created by the diaphragms to a work piece. In one embodiment, the point on the work piece to which the arm portion is connected is positioned entirely to one side of the diaphragm actuator. Thus the diaphragm actuator of the present invention has particular applicability to situations in which there is accessibility to only one side of the work piece or the force receiving point.

The diaphragm actuator of the present invention is further configured such that a plurality of such actuators can be positioned in side by side relationship relative to one another and/or stacked vertically relative to one another. With such a structure, diaphragm actuation systems can be designed for exerting opposed linear forces at closely adjacent work pieces or force receiving points. Alternatively, a single stack actuator can be provided with a single piston and opposed pressure chambers.

In a further embodiment, a single diaphragm and associated piston is provided. In this further embodiment, the piston is preferably provided with a spring return. In many or all embodiments it is preferable to reduce the volume of the chambers as much as possible to increase the speed or frequency of the forces. In certain embodiments, this volume is eliminated entirely.

Accordingly, it is an object of the present invention to provide a diaphragm actuator capable of providing extremely accurate, high speed and repeatable linear forces to a work piece.

Another object of the present invention is to provide a precision diaphragm actuator which eliminates inaccuracies due to friction and/or leakage.

Another object of the present invention is to provide a multiple diaphragm actuator in which fluid pressure cells can be positioned adjacent to one another and/or stacked vertically relative to one another to increase the density of force receiving points.

A still further object of the present invention is to provide a diaphragm actuator capable of accurate, high speed and repeatable force output in response to differential pressure input.

These and other objects of the present invention will become apparent with reference to the drawings, the description of the preferred embodiment and the appended claims.

DESCRIPTION OF THE PREFERRED EMBODIMENT

In general, the present invention relates to a diaphragm actuator. More specifically, the invention relates to a multiple diaphragm actuator for selectively providing an accurate and repeatable two-directional linear force with a small stroke. The actuator of the present invention is comprised of a plurality of pressure chamber or port housing layers and a plurality of piston housing layers. These layers are stacked relative to one another to define a plurality of fluid pressure chambers or cells and actuator arm access openings. Forces generated by the introduction of fluid pressure into the pressure chambers are transferred to a work piece (not shown) or other force receiving point by an actuator arm assembly. Although the preferred embodiment discloses an actuator having a plurality of opposing pairs of pressure fluid chambers and accordingly a plurality of actuator arm assemblies, the benefits of the present invention can also be realized with a single pair of fluid pressure chambers and a single actuator arm assembly.

Figure 1:
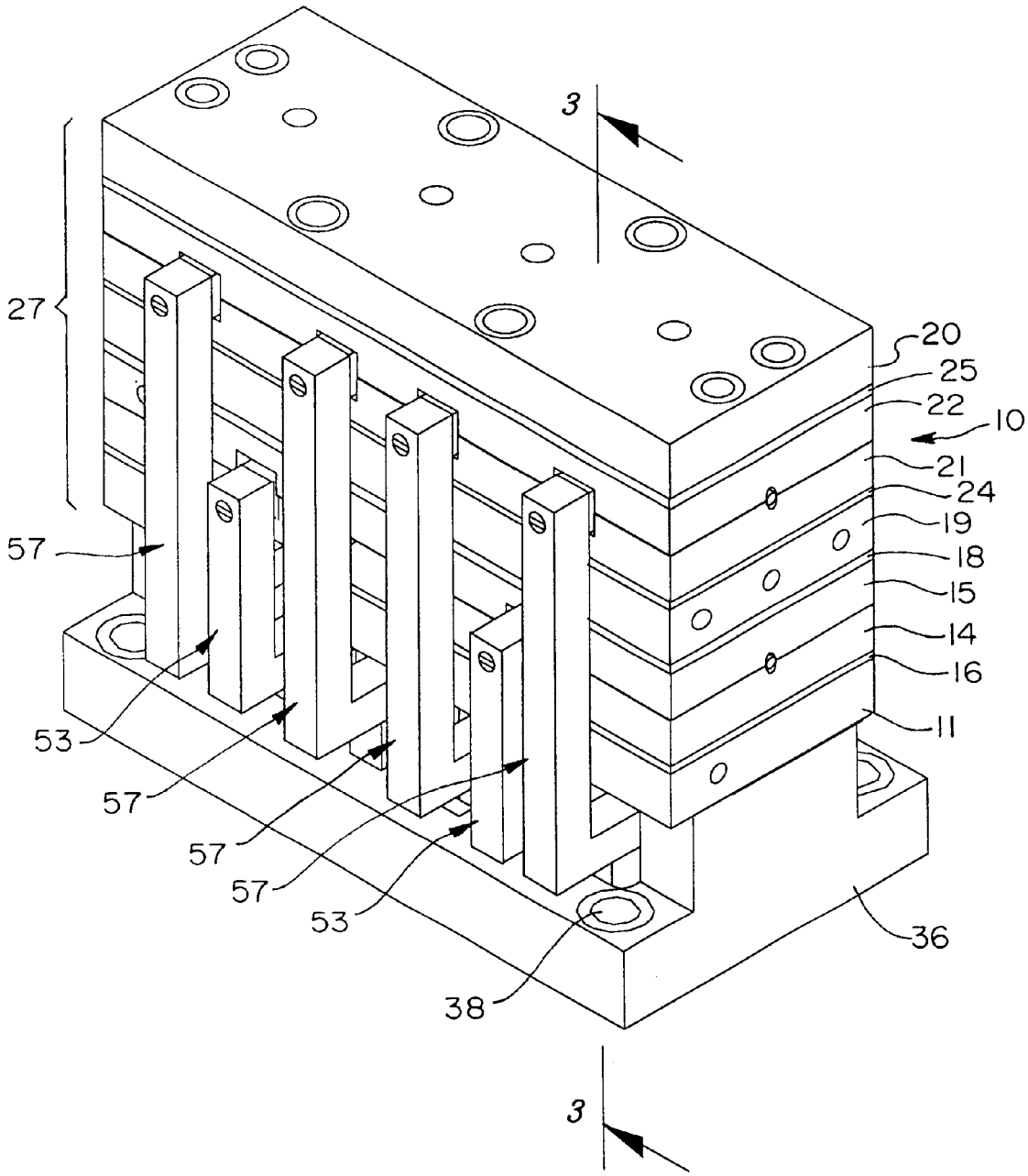
FIG. 1 is an isometric view of a fully assembled multi-diaphragm actuator in accordance with the present invention.
Figure 2A:
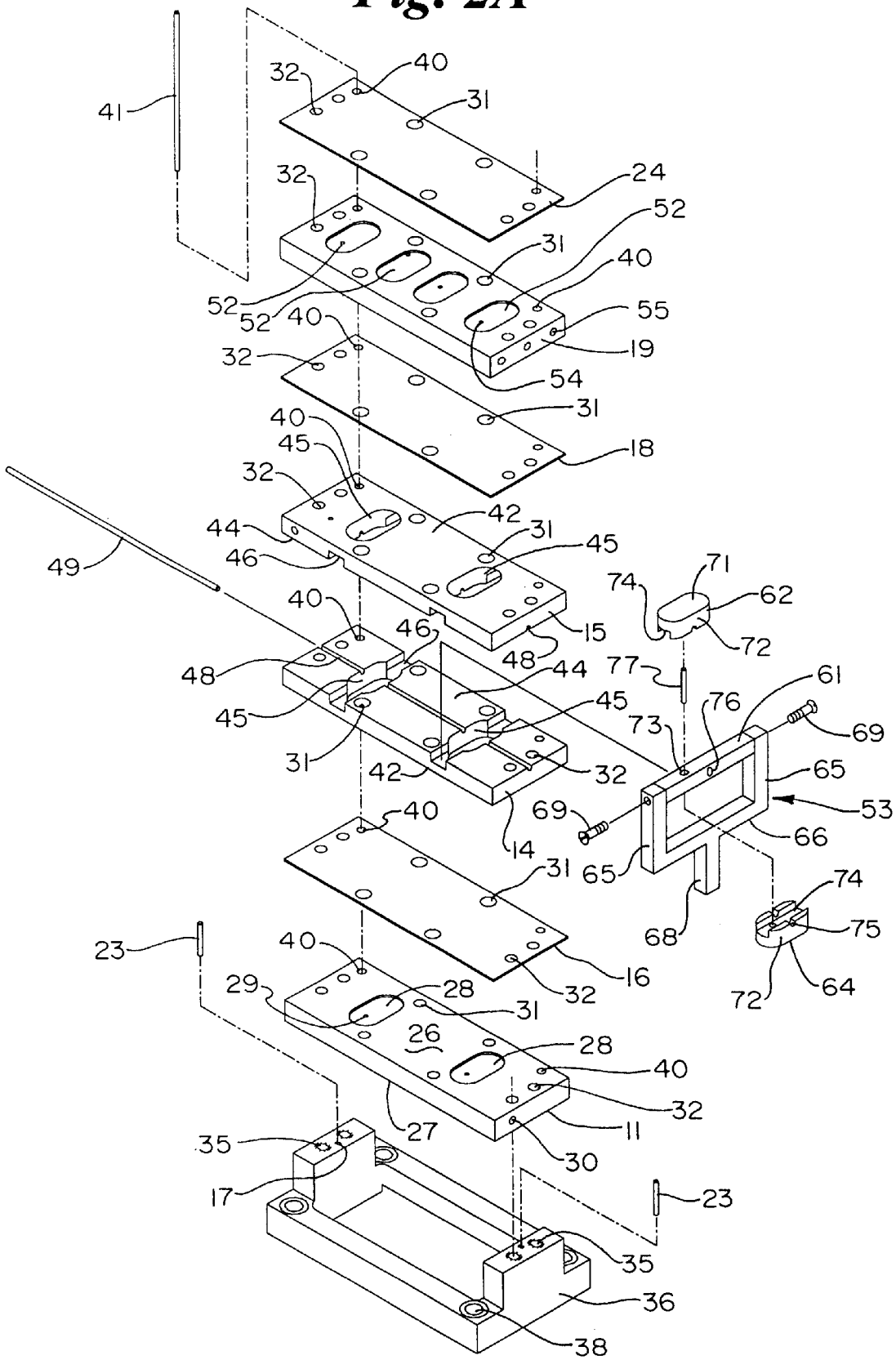
FIG. 2 is comprised of FIGS. 2A and 2B which are isometric, exploded views of the multi-diaphragm actuator of FIG. 1.
Figure 2B:
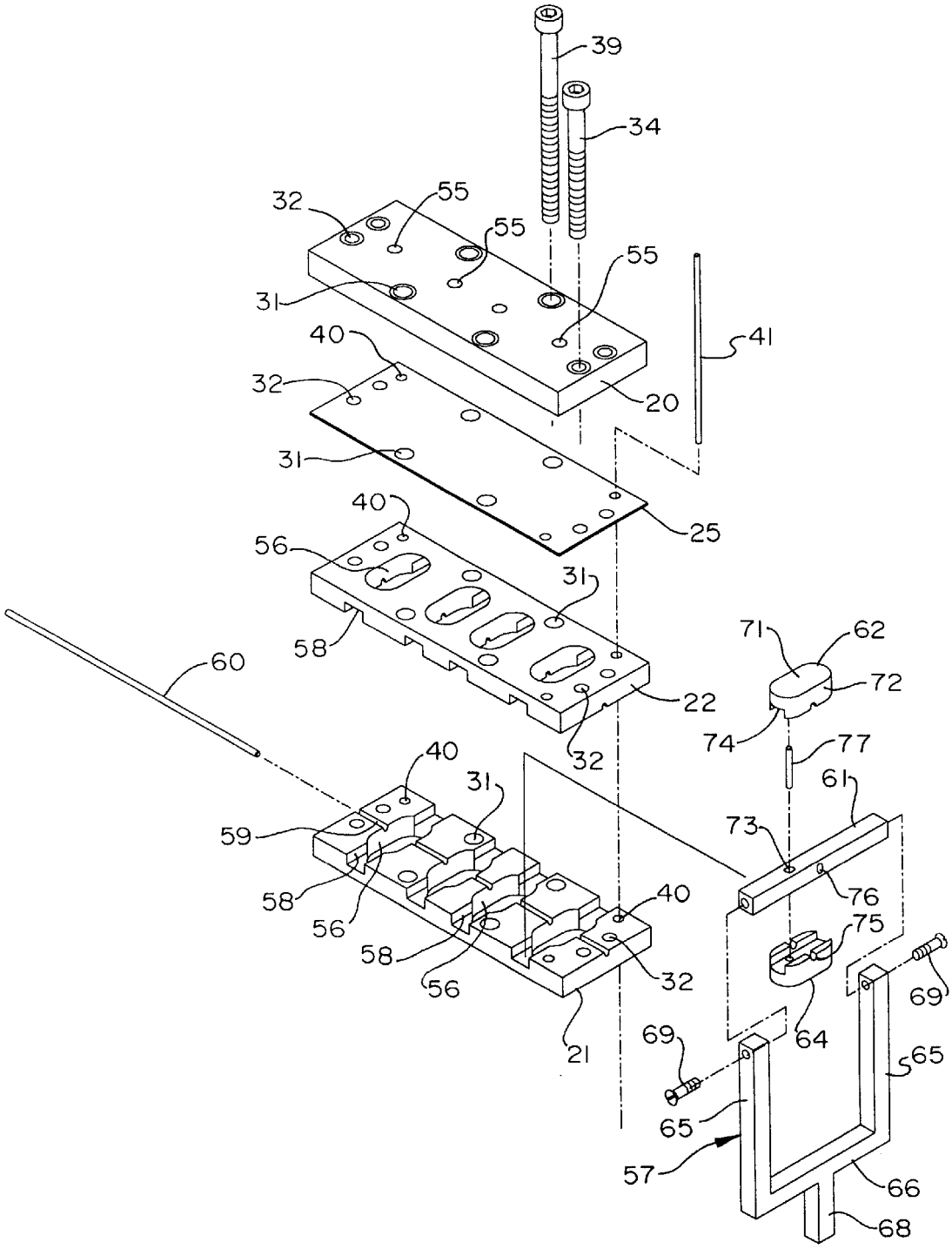
Figure 3:
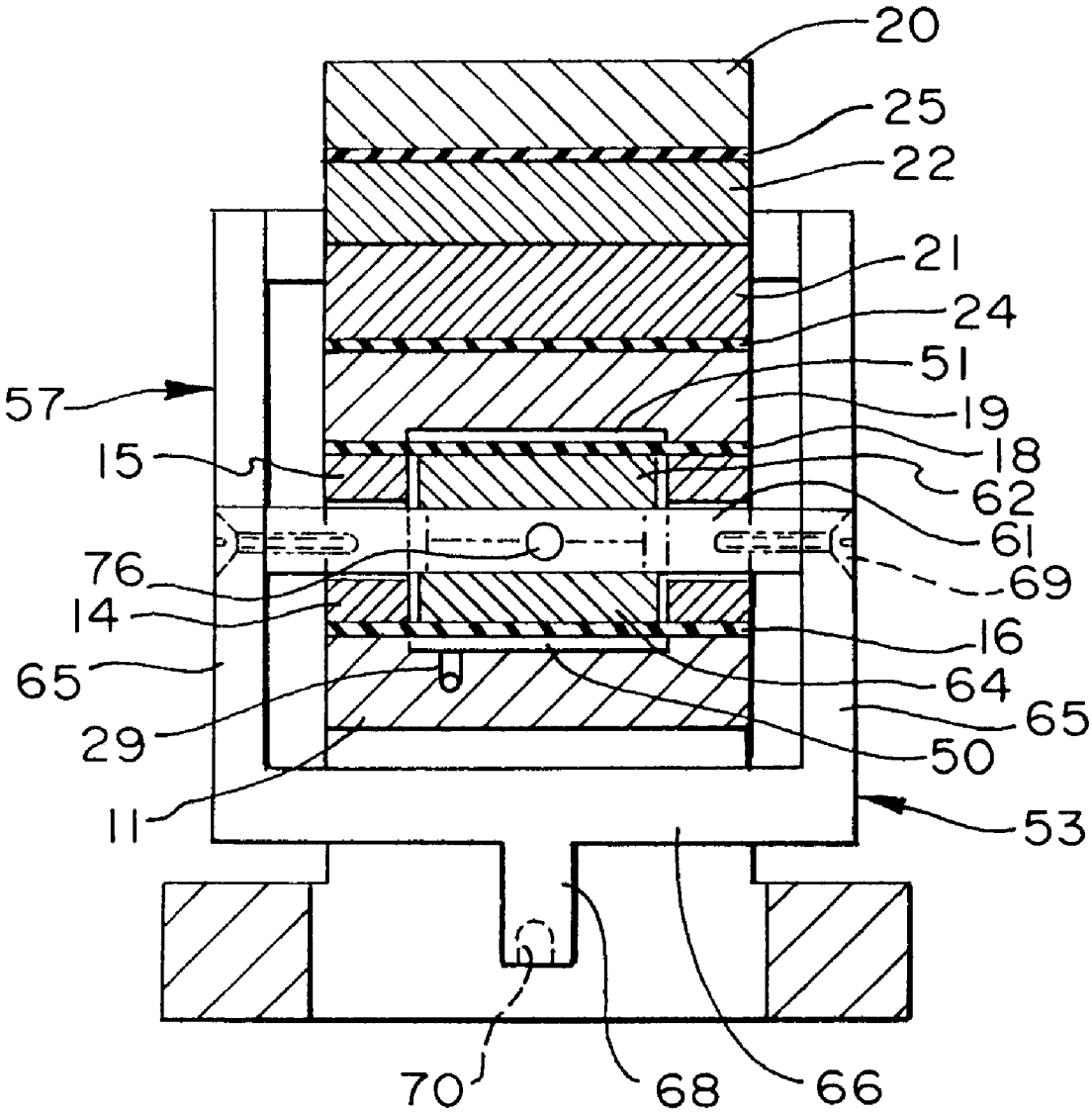
FIG. 3 is a view, partially in section, as viewed along the section line 3—3 of FIG. 1.

Reference is first made to FIGS. 1, 2 and 3 illustrating various views of the actuator of the present invention. Specifically, FIG. 1 discloses a fully assembled actuator in accordance with the present invention while FIG. 2 comprising FIGS. 2A and 2B shows an exploded view. FIG. 3 is a sectional view of one pair of fluid pressure chambers and a corresponding actuator arm assembly.

The actuator 10 of the preferred embodiment includes a base 36 and a stack 27 (FIG. 1) of actuator members mounted to the base 36. The base 36 includes a plurality of mounting holes 38 for connection to a substrate or other support.

A first or bottom set of actuator members includes a pair of spaced port housings comprising the bottom housing 11 and the bottom portion of the combination housing 19, a pair of piston guide housings 14 and 15 positioned between the housings 11 and 19 and a pair of diaphragms 16 and 18 positioned between the housings 11 and 14 and the housings 19 and 15, respectively.

The actuator further includes a second set of actuator members stacked on the first which includes a pair of port housings comprising the top portion of the combination housing 19 and the top housing 20, a pair of piston guide housings 21 and 22 positioned between the housings 19 and 20 and a pair of diaphragms 24 and 25 positioned between the housings 19 and 21 and the housings 20 and 22, respectively.

As illustrated best in FIG. 2A, the bottom port housing 11 has a generally rectangular configuration with spaced, generally parallel and planar top 26 and bottom 27 surfaces. The bottom surface 27 is provided with a pair of alignment holes (not shown) aligned with the holes 17,17 in the base 36 and adapted to receive alignment pins 23 to maintain desired alignment between the housing 11 and base 36. The top diaphragm receiving surface 26 is provided with a pair of pressure chamber cavities 28, 28 having generally straight sides and rounded ends; however, the configuration of such cavities is not critical. Each of the cavities 28, 28 is provided with a fluid inlet/outlet port 29 for the selective introduction and exhaustion of fluid pressure. The ports 29, 29 are in communication via internal fluid passageways to port connection openings 30 in the edges of the housing 11. These openings are designed for connection to a source of fluid pressure (not shown). The housing 11 is further provided with a plurality of actuator clamp holes in the form of a plurality of side holes 31 and a plurality of end holes 32. The end holes 32 are through holes adapted to receive clamp screws 34 (FIG. 2B) which extend through the holes 32 and are threadedly received by threaded openings 35 in the base 36. The side holes 31 are not through holes, but are threaded to receive threaded clamp screws 39 (FIG. 2B).

The planar surface 26 is also provided with a pair of alignment openings 40, 40 for receiving a pair of alignment pins 41. As will be seen, each layer in the stack of layers making up the actuator of the preferred embodiment includes similarly positioned alignment holes 40, 40. Thus, the alignment pins 41 must be sufficiently long to extend through all of the layers.

The bottom portion of the opposing port housing 19 is similar to the top portion of the housing 11 in that it includes a generally planar surface, a pair of corresponding pressure chamber cavities with fluid inlet/outlet ports and port connection openings, a plurality of clamp holes 31 and 32 and a pair of alignment holes 40, 40. In FIG. 2A, the planar surface of the housing 19 with the pair of pressure chamber cavities is located on the bottom of the housing 19; thus, these elements cannot be seen in FIG. 2A. The bottom or underside of the housing 19, however, is the mirror image of the top planar surface 26 of the housing 11. Thus, the position and the configuration of the fluid pressure cavities on the underside of the housing 19 as shown in FIG. 2A substantially matches and is aligned with those corresponding elements in the top planar surface 26 of the housing 11.

The piston housings 14 and 15 positioned between the port housings 11 and 19 are also substantial mirror images of one another. Each of these housings 14 and 15 has a generally rectangular configuration with an outer planar surface 42 facing a respective one of the housings 11 and 19 and an inner planar surface 44 facing the other of the housings 14 and 15. Each of the piston guide housings 14 and 15 further includes a pair of spaced piston guide openings 45,45 extending through the housings 14 and 15.

The piston guide openings 45,45 have a configuration similar to that of the pressure chamber cavities 28,28 and are spaced so that when the housings are assembled, the guide openings 45,45 will be aligned with the cavities 28,28. An actuator arm access groove 46 is formed in the surface 44 of each of the housings 14 and 15 and extends from each end of the piston guide openings 45 to the side walls of the housings. When assembled, opposed access grooves 46 of adjacent housings 14 and 15 provide access openings for the actuator arm assembly as will be described in greater detail below. Each of the inner planar surfaces 44 is further provided with an elongated alignment or retaining slot 48. The slot 48 extends from one end of each housing 14 and 15 to the other and is adapted for receiving an alignment or retaining rod 49. When assembled, the rod 49 is received in the slot 48 and extends through an opening in the actuator arm assembly 13. As will be described below, this assists in aligning and/or retaining the actuator arm assembly 13 relative to the main body of the actuator.

The piston guide housings 14 and 15 also include a plurality of actuator clamp holes 31 and 32 for alignment with the clamp holes 31 and 32 of the housings 11 and 19. A pair of alignment holes 40 are also provided in each of the housings 14 and 15 in positions corresponding to the alignment holes 40,40 in the housings 11 and 19 to assist in alignment of the housings during assembly.

Positioned between the housings 11 and 14 and between the housings 19 and 15 are diaphragms 16 and 18, respectively. Each of the diaphragms 16 and 18 has a generally rectangular planar configuration substantially conforming in size to the rectangular configuration of the housings between which they are positioned. The diaphragms also include clamp holes 31 and 32 and alignment holes 40 aligned with the corresponding holes 31, 32 and 40 in the housings. Each diaphragm 16 and 18 includes a first planar pressure chamber side for engagement with the planar surface 26 of the port housings 11 and 19 with which it is associated and an opposite planar piston side for engagement with the outer planar surface 42 of the piston housing 14 or 15 with which it is associated.

When the diaphragms 16 and 18 are positioned between their respective housings 11,14 and 19,15, and clamped in a sealing position by the clamp screws 34 and 39, the cavities 28,28 and that portion of diaphragms 16 and 18 extending over the cavities 28,28 form and define a pair of fluid pressure chambers 50 and 51 (FIG. 3). Accordingly, the diaphragms 16 and 18 are moveable away from their respective pressure chambers in response to fluid pressure in such chambers. Specifically, the diaphragms 16 and 18 are moveable in opposite directions in response to pressure within their respective chambers. It should be noted that these chambers 50 and 51 are totally closed with no seals and no openings or possibility of leakage other than the seal between the planar surfaces of the housings 11 and 19 and their respective diaphragms 16 and 18 and other than the inlet/outlet ports 29,29. When clamped between the housings 11,14 and 19,15, the diaphragms 16 and 18 lie in first and second parallel planes, respectively.

The second or top set of actuator members includes a similar structure. Specifically, the second set includes a pair of port housings comprising the top portion of the housing 19 and the top housing 20, a pair of piston guide housings 21 and 22 positioned between the housings 19 and 20 and a pair of diaphragms 24 and 25 positioned between the housings 19 and 21 and the housings 20 and 22, respectively. Similar to corresponding elements in the first set of actuator members, the housings 19, 20, 21 and 22 and the diaphragms 24 and 25 are all provided with corresponding and aligned clamp holes 31 and 32 and corresponding and aligned alignment holes 40,40. Also, similar to the port housing 11 and the bottom portion of the port housing 19, the top portion of the port housing 19 and the top port housing 20 includes a plurality of pressure chamber cavities 52. As shown, however, whereas each of the port housings in the bottom set is provided with a pair of spaced cavities, each of the port housings in the top set is provided with four spaced cavities 52. Each of the cavities 52 is provided with a corresponding fluid inlet/outlet port 54. The ports 54 in turn communicate through internal passages with the port openings 55 at the edges of the housing 19 or on the surface of the housing 20 for connection with an appropriate source of fluid pressure.

Each of the piston housings 21 and 22 is also similar to the corresponding piston housings 14 and 15 except that the piston housings 21 and 22, like their associated port housings 19 and 20, are provided with four, rather than two, piston guide openings 56 and corresponding actuator arm access openings 58. Each of the housings 21 and 22 is also provided with an alignment or retaining slot 59 for receiving an alignment or retaining rod 60.

When the housings 11, 14, 15, 19, 20, 21 and 22 and the diaphragms 16, 18, 24 and 25 are positioned together in a stacked relationship as shown in FIG. 1 and retained in that position by the clamp screws 34 and 39, the diaphragms 16, 18 and 24, 25 in conjunction with their respective port housings 11, 19 and 19,20 form fluid pressure chambers in the areas of the cavities 28 and 52. These chambers are characterized by the absence of any seals or friction capable of causing leakage of fluid from the chambers. Thus, when fluid pressure of a specified amount is selectively introduced into the chambers via the inlet/outlet ports 29 or 54, a highly accurate and repeatable force is exerted against the diaphragm in a direction away from the respective chambers.

In the embodiment of FIGS. 1, 2, and 3, two sets of actuator arm assemblies 53 and 57 are provided to transfer the linear forces from the respective pressure chambers to a work piece or other force receiving point. In general, the actuator arm assemblies 53 and 57 include a first portion comprising a force transfer arm 61 and a pair of piston halves 62 and 64 and a second portion comprising the arm portions 65,65 and 66 and the connection stub 68. In the preferred embodiment, the arm 61, the arm portions 65,65 and 66 and the member 68 are structurally rigid members capable of transmitting the forces generated by the pressure chambers without significant distortion. In the preferred embodiment, the arm portions 65,65 and 66 and the member 68 form a single, integral, rigid yoke member which is connected to the ends of the arm 61 by a pair of threaded screws 69,69 as shown in FIGS. 2 and 3. It is contemplated, however, that the entire actuator arm assembly could be constructed of a single integral piece. Preferably, the member 68 includes an internal threaded portion 70 (FIG. 3) to facilitate connection to the work piece or to a connecting member for a work piece.

In the preferred embodiment, as shown best in FIG. 3, the member 68 is positioned outside or entirely to one side of the actuator and is generally collinear with a line perpendicular to the diaphragms or diaphragm planes and extending through the moment center of each of the pressure chambers. This structure is particularly applicable to situations where there is force application accessibility to only one side of a work piece. As shown, the arms 65,65 and 66 of the actuator arm assemblies extend into the open central area of the base 36 to provide this accessibility and work piece connection.

It should be noted that the arm assemblies 53 associated with the pressure chambers of the housing 11 and 19 are identical with those of the arm assemblies 57 associated with the housings 19 and 20 except that the arm portions 65,65 of the assemblies 57 are longer to accommodate vertical stacking of the actuators.

Figure 4:
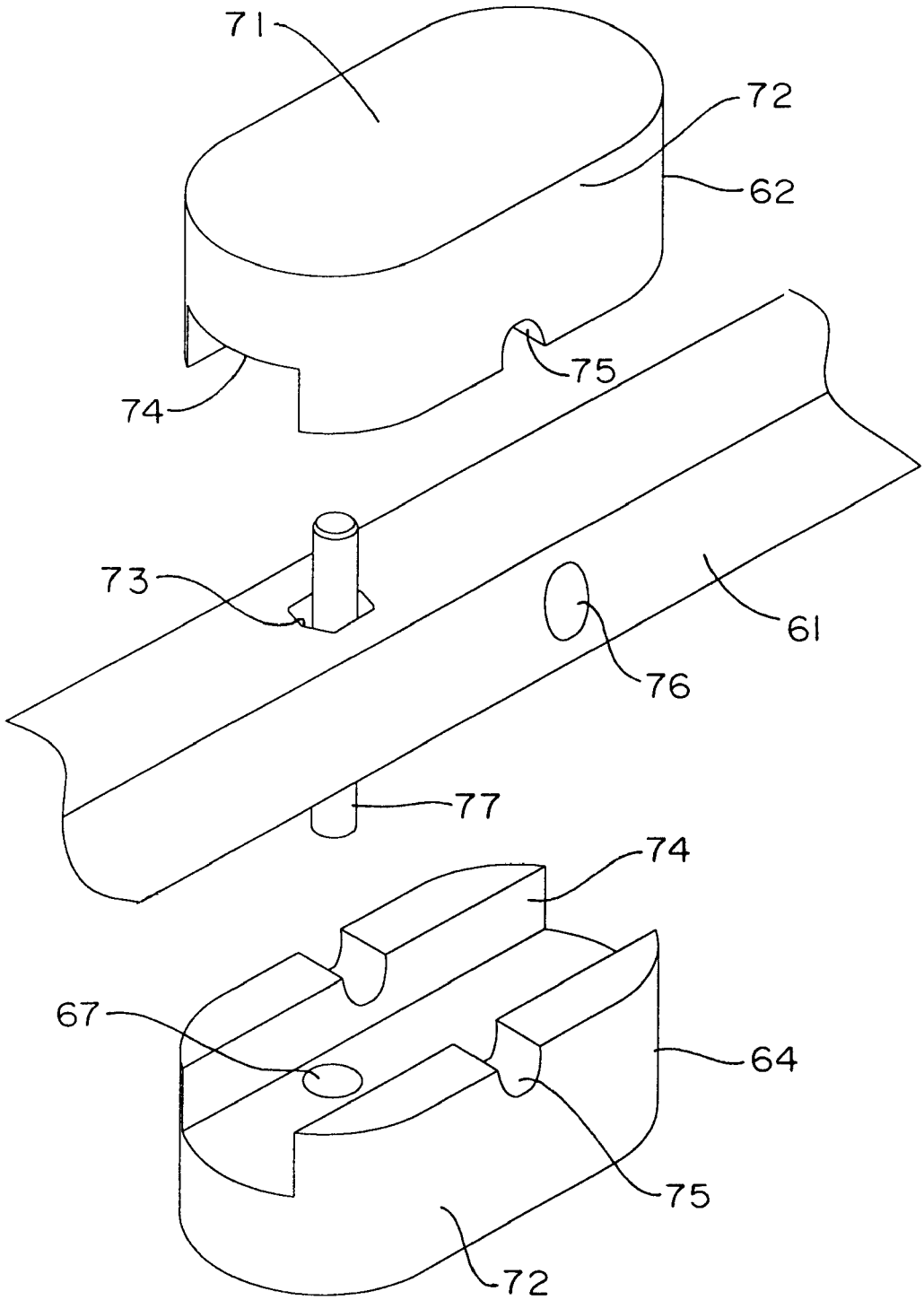
FIG. 4 is an isometric, exploded view showing a portion of the actuator arm assembly including the pistons.

As shown best in FIGS. 2 and 4, each of the piston halves 62 and 64 includes a generally planar surface 71 adapted for engagement with an outer surface portion of a respective diaphragm and a side surface 72 extending from the planar surface 71 at substantially 90°. The planar surface 71 has a configuration substantially matching the configuration of the piston openings 45 (in the housings 14 and 15) and 56 (in the piston housings 21 and 22). The dimensions of the planar surface 71 are slightly smaller than the cross-sectional dimensions of the piston openings 45 and 56 to permit free sliding movement in a linear direction perpendicular to the surface 71. Preferably, however, the dimensions of the surface 71 should be as large as possible while still allowing for such free movement. The side walls 72 extend from the planar surface 71 providing each piston half with a configuration fitting within the piston openings 45 and 56. Each of the piston halves 62 and 64 includes a centrally positioned actuator arm receiving channel 74 extending from one end to the other to receive the actuator arm 61 and to transfer forces from the pressure chambers and pistons 62 and 64 to the arm 61.

Each of the piston halves further includes a pair of alignment notches 75,75 extending transversely across the piston halves 62 and 64. When the piston halves are assembled within the piston openings 45 and 56, the notches 75 are aligned with the alignment and retaining slots 48 and 59 of the housings 14,15 and 21,22, respectively and with an alignment hole 76 in the arm 61. An alignment hole 73 is provided in the arm 61 and alignment hole 74 is provided in each of the pistons 62 and 64 to receive an alignment pin 77 to maintain desired alignment between the arm 61 and pistons 62 and 64. When the actuation assembly is assembled, the pistons 62 and 64 are engaged by the arm 61 at a point midway between its outer ends. The outer ends of the arm 61 extend outwardly beyond the edges of the housings 11, 14, 15 and 19 to permit connection with the arms 65,65 of the yoke member.

Having described the structure of the embodiment of FIGS. 1–4, the assembly and operation of the actuator of such embodiment can be understood best as follows.

First, the bottom port housing 11 is positioned relative to the actuator base 36 by positioning the alignment pin 23 into the alignment holes 17 and the corresponding alignment holes on the bottom surface 27 of the housing 11. Next, the alignment pins 41,41 are inserted into the alignment holes 40,40 on the top surface 26 of the housing 11. The diaphragm 16 and the piston housing 14 are then stacked onto the housing 11 with the alignment pins 41,41 extending through the alignment openings 40,40 in those elements.

Next, the actuator arm assembly 53 for each of the pressure chamber cavities 28,28 is assembled by positioning the piston halves 64 into the piston openings 45 in the housing 14 and subsequently positioning the arm 61 within the groove 74 of the piston half 64. The guide pin 77 is then inserted through the alignment hole 73 of the arm 61 and into the alignment hole 67 of the piston half 64. The other piston half 62 is then positioned onto the arm 61 so that the pin 77 extends into the alignment hole 67 of the piston half 62. At this time, the alignment and retaining rod 49 may also be inserted into the groove 48 and through the opening 76 in the arm 61 to retain the arm 61 relative to the housings 14 and 15 and the piston halves 62 and 64.

Next, the housing 15, the diaphragm 18, the housing 19, the diaphragm 24 and the housing 21 are sequentially stacked onto the housing 14 with the orientation illustrated in FIG. 2. The actuator arm assemblies 57 for the chamber cavities 52 are then similarly assembled and mounted within the piston openings 56 and access slots 58. Following this, the remaining piston housing 22, the diaphragm 25 and top port housing 20 are sequentially stacked so that the alignment pins 41 are aligned with and extend through or into the alignment openings 40 as shown. The clamp screws 34 and 39 are then inserted into the clamp openings 31 and 32 respectively and tightened. It should be noted that the clamp screws 34 extend through the various clamp openings 32 and are threadedly received by internal threads 35 in the base 36, while the clamp screws 39 extend through the various clamp openings 31 and are threadedly received by internal threads in the port housing 11.

Finally, the yoke of the arm assemblies comprising the arm portions 65,65,66 and the member 68 are connected with the arm 61 by the threaded members 69 (FIGS. 2 and 3).

The operation of the various diaphragm actuators within the stack of diaphragm actuators can be understood best with reference to FIG. 3. As shown, the tolerances between the diaphragms 16 and 18, the piston halves 62 and 64 and the arm 61 are minimal so that any pressure differentials within the pressure chambers 50 and 51 are transferred to the arm assembly 53. This pressure or force differential is then transferred via the arm assembly 53 to the work piece. Forces within the chambers 50 and 51 are generated by selective introduction of fluid pressure into these chambers through the inlet/outlet ports 29,29. The fluid pressure can be generated by any conventional means. Preferably, however, the pressure is supplied from one or more proportional values whose pressure output is controlled by electrical input.

Figure 6:
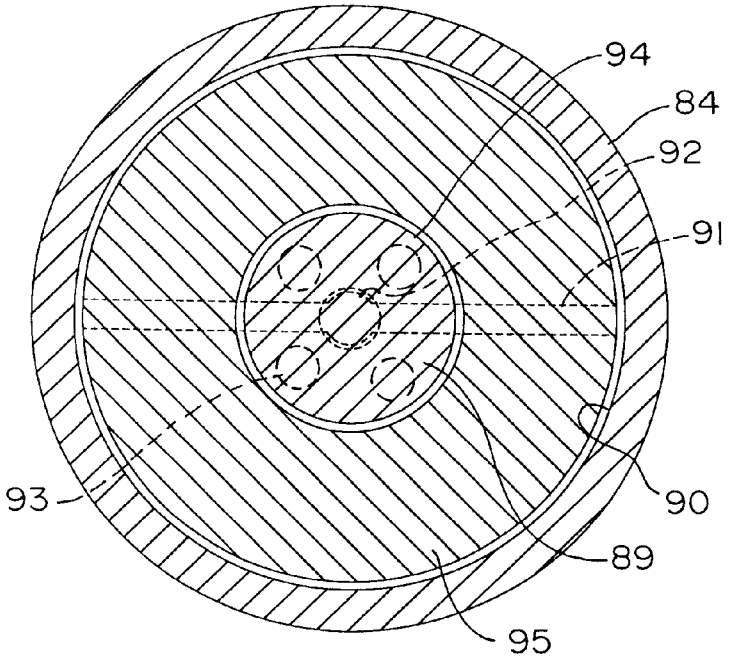
FIG. 6 is a view, partially in section, as viewed along the section line 6—6 of FIG. 5.
Figure 5:
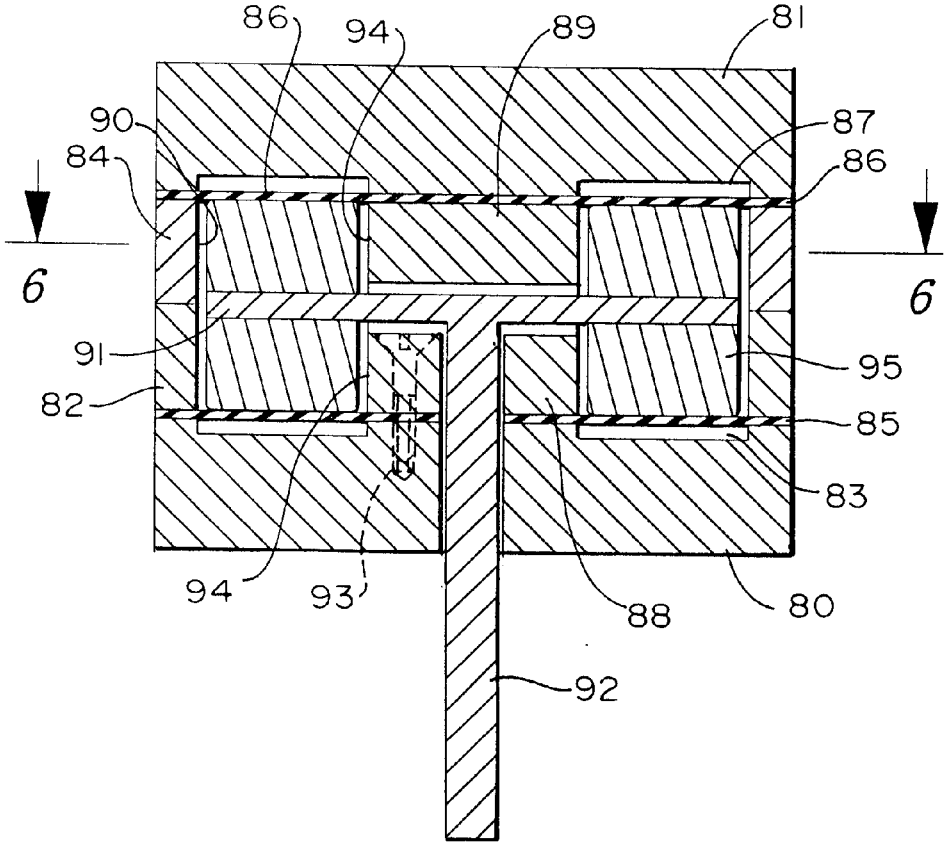
FIG. 5 is a side view, with portions broken away and partially in section, of a modified actuator in accordance with the present invention.

Reference is next made to FIGS. 5 and 6 showing a modified embodiment in accordance with the present invention. The embodiment of FIGS. 5 and 6 includes a pair of port housings 80 and 81 each having generally annular or doughnut shaped cavities 83 and 87, respectively surrounding a center portion. Positioned between the housings 80 and 81 are a pair of piston housings 82 and 84. The housings 82 and 84 are annular members each have a generally planar inner surface for engagement with one another and a generally planar outer surface positioned adjacent to the port housings 80 and 81, respectively. A first diaphragm 85 is positioned between the piston housing 82 and the port housing 80 to define a generally annular or doughnut shaped fluid pressure chamber in the area of the cavity 83 and a second diaphragm 86 is positioned between the piston housing 84 and the port housing 81 to define a generally annular or doughnut shaped fluid pressure chamber in the area of the cavity 87. As illustrated, each of the piston housings 82 and 84 includes an inner cylindrical surface conforming substantially in size to the outer circular edge of the cavities 83 and 87. When assembled in a stacked relationship as shown best in FIG. 5, the inner surfaces 90 of the piston housings 82 and 84 form an outer piston guide surface.

A pair of spacer elements 88 and 89 are connected with the center portions of the housings 80 and 81, respectively, to seal the center portions of the diaphragms 85 and 86 against the planar surfaces of the housings 80 and 81. The elements 88 and 89 have a generally cylindrical outer surface 94 to provide an inner piston guide surface for a piston 95. As shown, the piston 95 has generally annular top and bottom surfaces substantially matching the configuration of the cavities 83 and 87.

The spacer elements 88 and 89 are secured to the housings 80 and 81 by any conventional means such as threaded members 93 or the like. The piston 95 is part of an actuator arm assembly for transferring force from the fluid pressure cavities 83 and 87 to a work piece. The actuator arm assembly includes a force transfer arm 91 extending laterally across the piston 95 between the spacer elements 88 and 89 and a center force transmitting rod 92 extending through an opening in the element 88 for transferring force from the arm 91 to a work piece. In the preferred embodiment, the dimensions of the spacer elements 88 and 89 are sufficiently shallow to provide room 97 for slight movement of the piston 95 and thus the arm 91. This facilitates transfer of force from the piston 95 to the rod 92 and thus the work piece.

The embodiment of FIGS. 5 and 6 can be modified, if desired, to replace the force transfer arm 91 with a force transfer disc or other structure for transferring force from the piston 95 to the rod 92 and thus the work piece.

Figure 7:
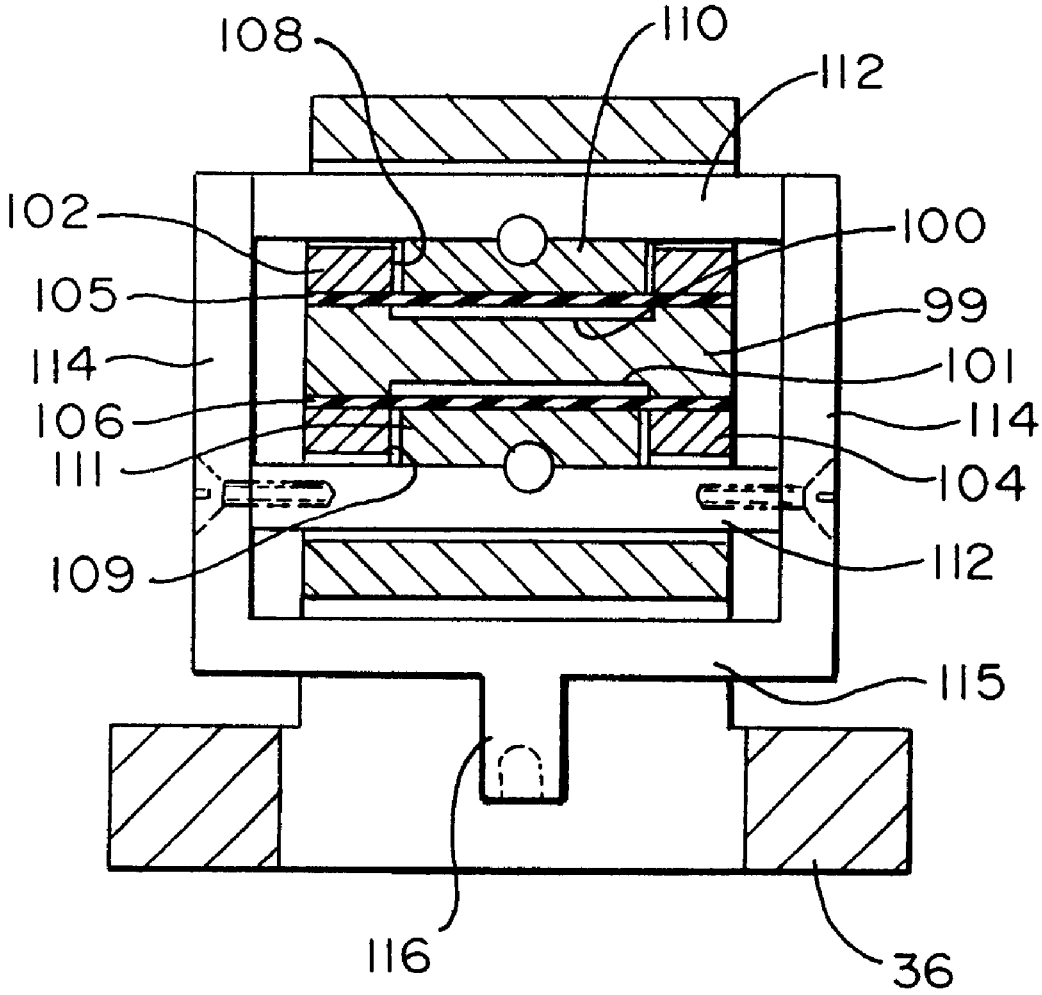
FIG. 7 is a sectional view of a further embodiment of a multi-diaphragm actuator in accordance with the present invention.

FIG. 7 illustrates a still further embodiment in accordance with the present invention. This embodiment is similar to that of the embodiment of FIGS. 1–4, except that the pressure chambers are defined by a single center port housing 99 and the actuator arm assemblies receives opposed outwardly directed (rather than inwardly directed) forces from the pistons. In the embodiment of FIG. 7, the center port housing 99 includes a pair of aligned fluid pressure cavities 100 and 101 on opposite sides of the housing 99. A pair of piston housings 102 and 104 are positioned adjacent opposite surfaces of the port housing 99 and a pair of diaphragms 105 and 106 are retained between the housings 102 and 104 and the housing 99 as shown.

Each of the piston housings 102 and 104 includes a piston guide opening 108 and 109, respectively. The openings 108 and 109 have a size and configuration substantially matching that of the cavities 100 and 101. Similar to the embodiment in FIGS. 1–4. The fluid pressure chambers defined by the cavities 100 and 101 and the diaphragms 105 and 106 are provided with pressure inlet/outlet ports which are connected to a source of fluid pressure (not shown).

An actuator arm assembly is associated with the pair of pressure chambers to transfer force generated within the chambers to a work piece. In the embodiment of FIG. 7, the actuator arm assembly includes a pair of pistons 110 and 111 and a plurality of rigid arms 112,112, 114,114, 115 and a connection member 116. As shown, the pistons 110 and 111 are positioned within the piston openings 108 and 109. The pistons have a surface closely associated with the diaphragms 105 and 106 so that they are responsive to fluid pressure introduced into the cavities 110 and 101. Each of the pistons is also connected with one of the generally transverse arms 112 for transferring movement of the piston to the work piece via the rigid arms 114,114, 115 and the member 116.

Figure 8:
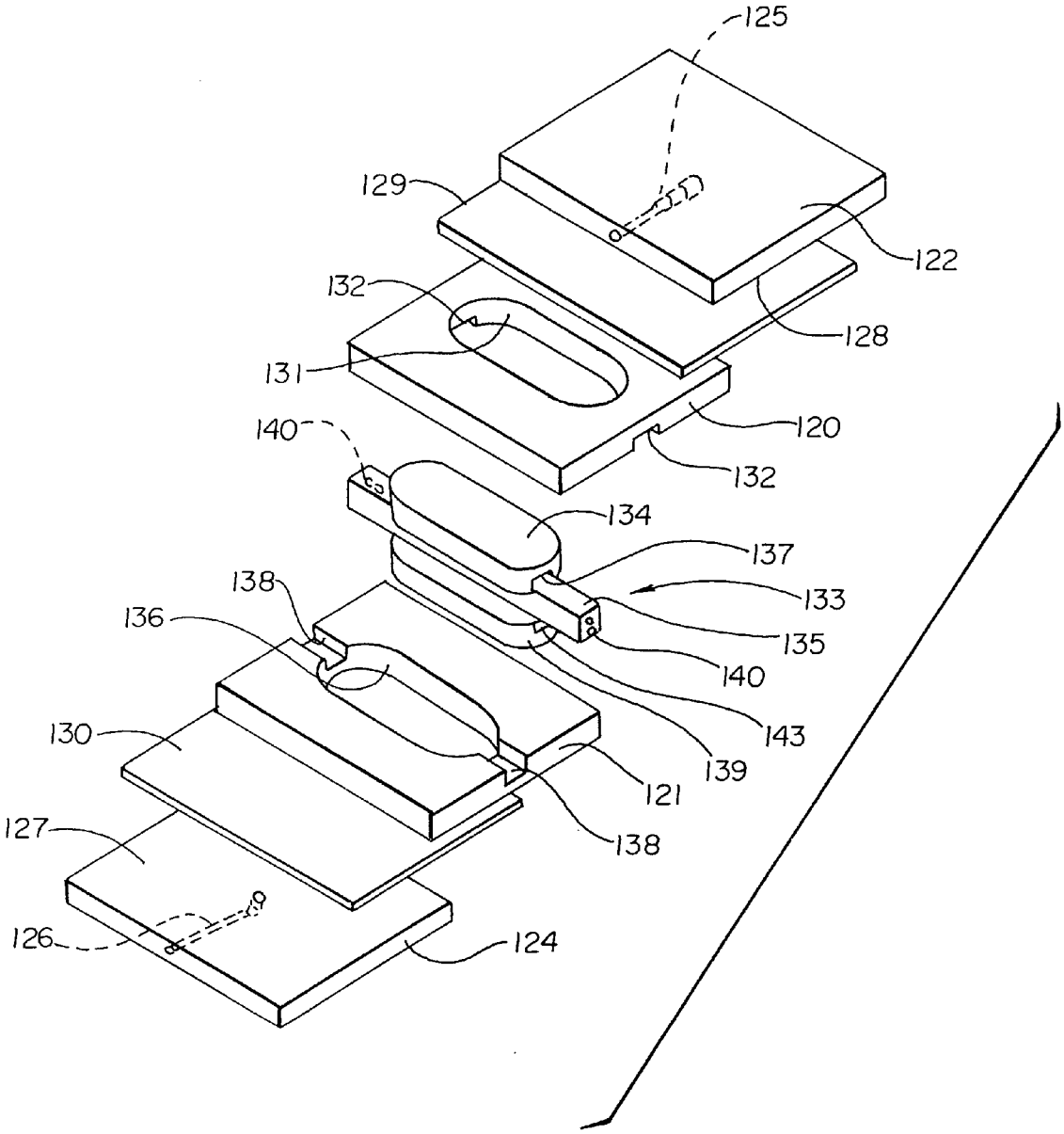
FIG. 8 is an isometric, exploded view of a further diaphragm actuator embodiment.
Figure 9:
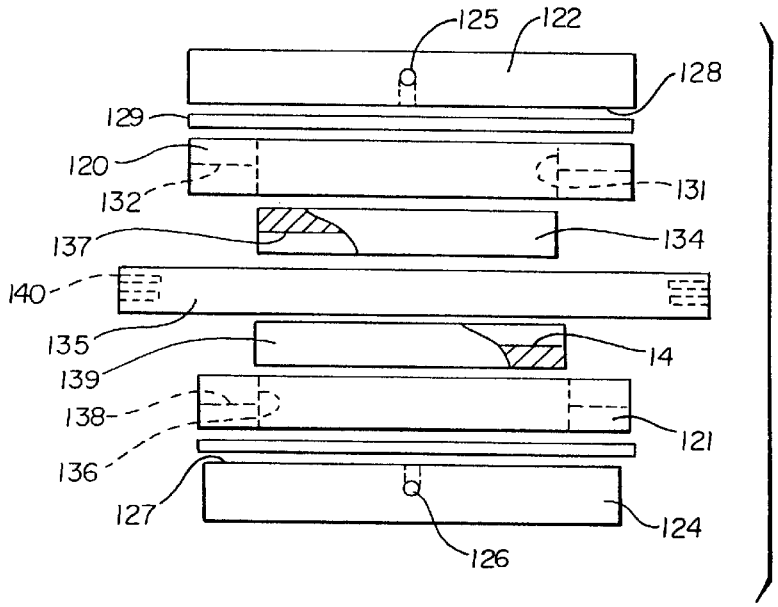
FIG. 9 is a side, exploded view of the diaphragm actuator embodiment of FIG. 8 in form for assembly

FIGS. 8 and 9 illustrate a still further embodiment of the present invention which comprises a single stack embodiment of a diaphragm actuator with a single piston. The single stack embodiment includes a pair of opposed piston housings 120 and 121 sandwiched between a first or top port housing 122 and a second or bottom port housing 124. Each of the port housings 122 and 124 includes a fluid supply and exhaust port 125 and 126, respectively, in communication with a chamber or cell surface of the port housings. In FIG. 8, the chamber surface 128 in the port housing 122 is a generally planar surface facing the piston housing 120, while the chamber surface 127 in the port housing 124 is a generally planar surface facing the piston housing 121. The chamber surfaces 128 and 127 are also substantially flat and planar relative to the surrounding surface areas of the housings 122 and 124.

Sandwiched between the port housing 122 and the piston housing 120 is a diaphragm 129 and sandwiched between the port housing 124 and the piston housing 121 is a diaphragm 130. When the entire stack of FIG. 8 is joined together as shown in FIG. 9, the diaphragms 129 and 130 lie directly against the chamber surfaces 128 and 127, respectively. Although the embodiments of FIGS. 1–7 show the port housings as being provided with a chamber having a recess to define the chamber, the present invention contemplates that such a recess can be eliminated so that the chambers are defined by the flat chamber surfaces 128 and 127 on one side and the diaphragms 129 and 130 on the other side.

The piston housing 120 includes a central piston guide opening 131 and a pair of piston guide arm openings 132 at each end of the guide opening 131. The opening 131 accommodates a piston half 134 while the openings 132 accommodate the piston arm 135 as described with respect to the other embodiments. The piston housing 121, like the housing 120, also includes a central piston guide opening 136 and a pair of side piston guide arm openings 138, 138. The opening 136 accommodates the piston half 139, while the openings 138, 138 accommodate the piston arm 135. Each of the piston halves 134 and 139 includes an inner channel 137 and 143, respectively, to accommodate the arm 135 as shown.

Internally, threaded openings 140 are provided at each end of the arm 135 for connection of the arm to one or more force receiving members. The openings 131 and 136, when their respective piston housings 120 and 121 are sandwiched between the port housings 122 and 124, define the outer perimeters of the pressure chamber surfaces 128, 127 and thus the pressure 6 chambers. The stack of the actuator elements of FIG. 8, including the housings 120, 121 and 122, 124, are clamped together by threaded members or the like in a manner similar to that of the other embodiments.

FIG. 9 shows a side view of the embodiment of FIG. 8 in an exploded ready to be assembled form in which the diaphragms 129 and 130 are designed to be retained flat against their respective chamber surfaces 128 and 127. This minimizes the volume of the chamber and provides for high speed cycles of the actuator. By introducing and exhausting pneumatic fluid pressure from the ports 125 and 126, the diaphragms 129 and 130 expand away from and retract toward their respective chamber surfaces. This causes corresponding movement of the piston 133, and thus the piston arm 135. Thus, any mechanism mounted to the opposite ends of the arm 135 will be caused to move as well.

Figure 10:
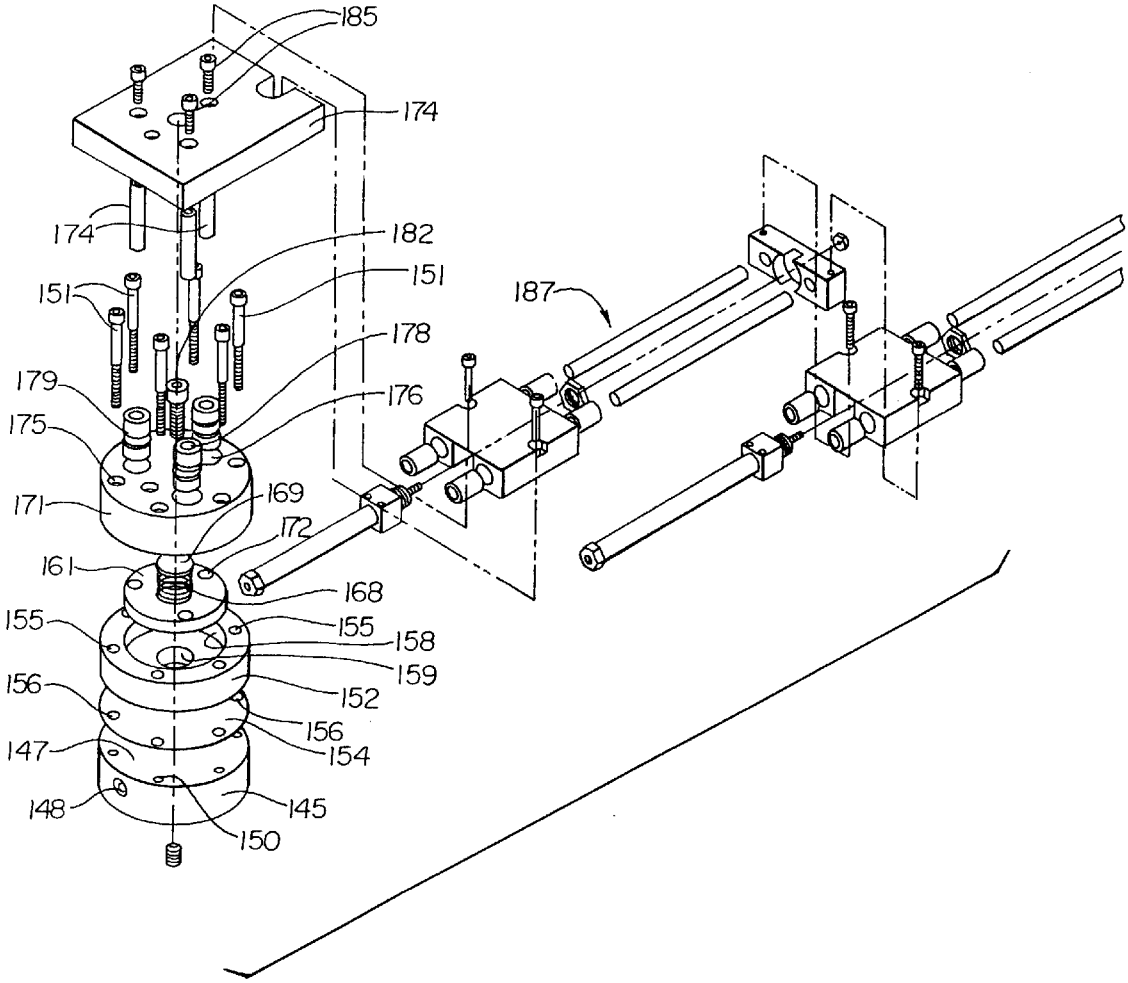
FIG. 10 is an isometric, exploded view of a further actuator embodiment of the present invention.
Figure 11:
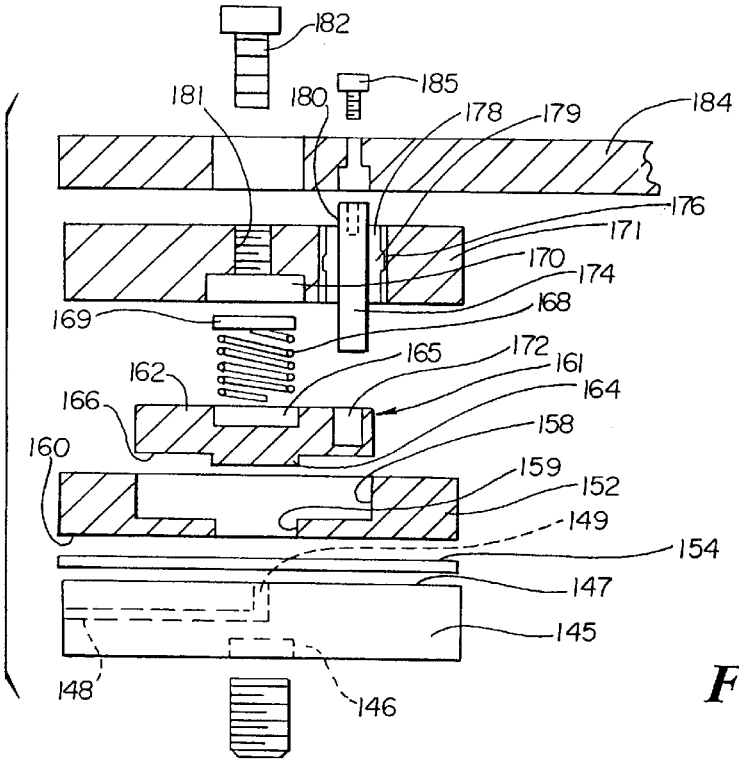
FIG. 11 is an elevational side, exploded view of the actuator embodiment of FIG. 10, with portions removed. .

A still further embodiment of a diaphragm actuator in accordance with the present invention is shown in FIGS. 10 and 11. This embodiment is a single diaphragm or single acting actuator with a spring return. In general, the actuator of FIG. 10 includes a housing assembly comprising a lower diaphragm or base housing 145, a piston housing 152 and a guide or bearing housing 171. More specifically, the housing 145 includes a mounting hole 146 on its lower surface for mounting the housing 145 and thus the entire actuator structure to a base or other structure (not shown). The housing 145 also includes a pressure port 148 which extends through the housing 145 and opens to the center portion of the top surface 147 of the housing 145 at the port opening 149. The top surface 147 is generally flat and planar and is provided with a plurality of internally threaded openings 150 to receive a plurality of clamping bolts 151 as will be described in further detail below.

A piston housing 152 is positioned adjacent to the lower housing 146 with a diaphragm 154 sandwiched therebetween. Each of the piston housing 152 and the diaphragm 154 is provided with a plurality of through holes 155 and 156, respectively, to receive the threaded clamp screws 151. The piston housing includes a first generally circular piston receiving recessed portion 158 and a second generally circular piston receiving recessed portion 159. The recessed portion 158 is open to the top of the housing 152 and in communication with the opening 159, while the portion 159 is open to the bottom surface 160 of the housing 152 to define a piston opening in the surface 160. The bottom surface 160 of the piston housing 152 is generally flat and planar and is designed for engagement with the top surface of the diaphgram 154 when the embodiment of FIGS. 10 and 11 is assembled. When assembled, the surface 147 includes a peripheral portion corresponding to, or positioned opposite to, the bottom surface 160 of the housing 152 and a pressure chamber portion in the area of the recessed portion or piston opening 159. Preferably, both the peripheral and pressure chamber portions are flat and lie in a common plane.

With continuing reference to both FIGS. 10 and 11, the piston 161 includes a first or upper piston section 162 which is designed for guided movement in the portion housing 158 of the piston housing 152 and a second or lower piston portion 164 which is designed for guided movement in the portion 159 of the piston housing 152. The bottom surface 166 of the piston portion 164 is designed to engage the top surface of the diaphragm 154 in the area of the recessed portion 159. The top surface of the piston 161 is provided with a generally cylindrical recessed area 165 for receiving one end of a compression or return spring 168. The spring 168 functions as a piston return spring and includes a spring cap 169 for seating within a spring receiving recess 170 (FIG. 11) within the bearing housing 171. The piston 161 further includes a plurality of guide shaft receiving openings 172. These openings 172 receive ends of a plurality of guide shafts or force transfer members 174 for guiding movement of the piston 161 as will be described in greater detail below.

The bearing housing 171 includes a plurality of clamp screw openings 175 aligned with the corresponding openings 150, 156 and 155 for receiving the clamp screws 151. When the embodiment of FIGS. 10 and 11 is assembled, the clamp screws 151 extend through the openings 175, then through the openings 155 and 156 in the housing 152 and diaphragm 154, respectively, and are then received by the threaded openings 150 in the lower housing 145. When the clamp screws 151 are tightened, the lower housing 145, the piston housing 152 and the bearing housing 171 are clamped together, with the diaphragm 154 sandwiched between the upper surface 147 of the housing 145 and the bottom surface 160 of the piston housing 161. This results in the formation of a diaphragm chamber between the bottom surface of the diaphragm 154 and the top surface 147 of the lower housing 145 in the area of the opening 159.

The bearing housing 171 is also provided with a plurality of bearing openings 176 for receiving a similar number of bearings 178. Each of the bearings 178 includes a central exterior portion 179 of slightly greater diameter to allow the bearing to tilt slightly within the hole 176 for proper alignment. Each bearing further includes a central opening 180 to receive the guide shafts 174. A central threaded opening 181 is provided to receive a spring adjustment screw 182. By threadedly advancing or retracting the screw 182 against the return spring cap 169, the force of the return spring 168 can be selectively adjusted.

Each of the upper ends of the guide shafts 174 is rigidly secured to the bottom surface of an upper plate 184 via a plurality of externally-threaded screws 185. A work piece 187 in the form of a lifting wiper or the like is connected to the upper plate 174 as desired.

When fully assembled, the piston 161 which is connected to the upper plate 184 via the guide shafts 174 is moveable relative to the bearing housing 171, the piston housing 152 and the lower housing 145. The piston is normally biased in a return or downward direction as shown in the figures via the return spring 168. To actuate the piston and move it against the force of the spring 168, pneumatic fluid pressure is introduced into the pressure port 148. This causes the diaphragm 154 in the area of the recessed portion 159 to move upwardly against the bottom surface 166 of the piston portion 164, thereby moving the piston 161, the upper plate 184 and its connected work piece 187.

The structure of FIGS. 10 and 11 facilitates short, rapid and repeatable movements with a relatively small amount of air movement. Further, the air is completely enclosed, with no leakage and thus makes the structure ideal for clean room or other similar environments.

Although the description of the preferred embodiment has been quite specific, it is contemplated that various modifications could be made without deviating from the spirit of the present invention. Accordingly, it is intended that the scope of the present invention be dictated by the appended claims rather than by the description of the preferred embodiment.

What is claimed is:

1. A diaphragm actuator comprising:

a housing comprised of;

a first housing having a first diaphragm receiving surface and a fluid inlet/outlet port, said port being open to said first diaphragm receiving surface, said first diaphragm receiving surface being substantially planar;

a piston housing having a second diaphragm receiving surface and a piston opening in said second diaphragm receiving surface;

a diaphragm positioned between said first diaphragm receiving surface and said second diaphragm receiving surface, said diaphragm having a first surface facing said first diaphragm receiving surface and a second opposite surface facing said second diaphragm receiving surface; and a piston positioned in said piston opening and engaged with said second opposite surface.

2. The diaphragm actuator of claim 1 further including a second housing adjacaent to said piston housing opposite said second diaphragm receiving surface.

3. The diaphragm actuator of claim 2 wherein said second housing is a guide housing which includes at least one guide opening.

4. The diaphragm actuator of claim 3 including a work piece connecting assembly comprising at least one force transfer member connected to said piston and extending through said guide opening for connection with a work piece.

5. The diaphragm actuator of claim 4 including a spring positioned between said second housing and said piston to exert a spring force against said piston in the direction of said diaphragm.

6. The diaphragm actuator of claim 4 wherein said second housing includes three guide openings and said work piece connecting assembly includes a force transfer member connected to said piston and extending through each of said three guide openings.

7. The diaphragm actuator of claim 6 wherein each of said force transfer elements is a guide shaft.

8. The diaphragm actuator of claim 4 including a bearing member mounted in said guide opening and having a center opening for receiving said force transfer element.

9. The diaphragm actuator of claim 8 wherein each of said force transfer elements is a guide shaft.

10. The diaphragm actuator of claim 1 wherein said first diaphragm receiving surface includes a peripheral surface portion positioned opposite to said second diaphragm receiving surface and a pressure chamber surface portion corresponding to said piston opening.

11. The diaphragm actuator of claim 10 wherein said pressure chamber surface portion and said peripheral surface portion are substantially planar and both lie in a common plane.

12. The diaphragm actuator of claim 2 including a spring positioned between said second housing and said piston to exert a spring force against said piston in the direction of said diaphragm.

13. The diaphragm actuator of claim 2 wherein said second housing includes a third diaphragm receiving surface and a fluid inlet/outlet port, said port being open to said third diaphragm receiving surface, said third diaphragm receiving surface being substantially planar, wherein said piston housing includes a fourth diaphragm receiving surface and a piston opening in said fourth diaphragm receiving surface, and wherein the diaphragm actuator includes a second diaphragm positioned between said third and fourth diaphragm receiving surfaces.

14. The diaphragm actuator of claim 13 wherein said piston openings in said second and fourth diaphragm receiving surfaces are aligned in a direction generally perpendicular to said second and fourth diaphragm receiving surfaces.

15. The diaphragm actuator of claim 11 including a second housing adjacent to said piston housing and wherein the diaphragm actuator includes a second diaphragm positioned between said third and fourth diaphragm receiving surfaces.

16. The diaphragm actuator of claim 15 wherein said third diaphragm receiving surface includes a peripheral surface portion positioned opposite to said fourth diaphragm receiving surface and a pressure chamber surface portion corresponding to the piston opening in said fourth diaphragm receiving surface wherein said pressure chamber surface portion and said peripheral surface portion are substantially planar and both lie in a common plane.

17. A diaphragm actuator comprising:

a first fluid pressure chamber having a first fluid inlet/outlet port and defined in part by a first diaphragm positioned in a first diaphragm plane, said first diaphragm being moveable away from said first fluid pressure chamber in a first direction in response to fluid pressure in said first pressure chamber;

a second fluid pressure chamber having a second fluid inlet/outlet port and defined in part by a second diaphragm positioned in a second diaphragm plane, said second diaphragm being moveable away from said second fluid pressure chamber in a second direction in response to fluid pressure in said second pressure chamber;

said first and second fluid pressure chambers being oriented such that said first and second diaphragms are substantially parallel to one another and said first direction and said second direction are opposite to one another;

an actuator arm assembly engaging said first diaphragm and said second diaphragm and including an actuator arm extending outwardly in opposite directions from the point of engagement between said arm assembly and said first and second diaphragms, said actuator arm including opposite ends for connection to a work piece.

18. The diaphragm actuator of claim 17 including a first housing having a first substantially planar diaphragm receiving surface and a second housing having a second substantially planar diaphragm receiving surface.

19. The diaphragm actuator of claim 18 wherein said first fluid pressure chamber is defined between said first diaphragm and said first diaphragm receiving surface and said second fluid pressure chamber is defined between said second diaphragm and said second diaphragm receiving surface.

* * * * *